US008863476B2

(12) United States Patent
Summers

(10) Patent No.: US 8,863,476 B2
(45) Date of Patent: Oct. 21, 2014

(54) BUILDING BLOCK SYSTEM

(76) Inventor: Gary Summers, Williamsport, PA (US)

( * ) Notice: Subject to any disclaimer, the term of this patent is extended or adjusted under 35 U.S.C. 154(b) by 376 days.

(21) Appl. No.: 12/974,232

(22) Filed: Dec. 21, 2010

(65) Prior Publication Data

US 2011/0146186 A1 Jun. 23, 2011

Related U.S. Application Data

(60) Provisional application No. 61/289,002, filed on Dec. 22, 2009.

(51) Int. Cl.

| | |
|---|---|
| ***E04B 2/00*** | (2006.01) |
| ***E04C 1/00*** | (2006.01) |
| *E04B 2/02* | (2006.01) |
| *E04B 9/18* | (2006.01) |

(52) U.S. Cl.

CPC ..... *E04C 1/00* (2013.01); *E04B 2002/0208* (2013.01); *E04B 9/18* (2013.01)

USPC ..... 52/747.12; 52/585.1; 52/590.2; 52/605

(58) Field of Classification Search

USPC ..... 52/585, 589.1, 590.1, 590.2, 596, 600, 52/604, 605, 606, 741.13, 745.1, 747.12; D25/112–118, 121–125

See application file for complete search history.

(56) References Cited

U.S. PATENT DOCUMENTS

| | | | | | |
|---|---|---|---|---|---|
| 3,382,632 | A | * | 5/1968 | Grofcsik | 52/223.7 |
| 3,410,044 | A | * | 11/1968 | Moog | 52/309.12 |
| 3,998,022 | A | | 12/1976 | Muse | |
| 4,107,894 | A | | 8/1978 | Mullins | |
| 4,123,881 | A | * | 11/1978 | Muse | 52/100 |
| 4,426,815 | A | | 1/1984 | Bron | |
| 4,475,326 | A | | 10/1984 | Hanson | |
| 4,640,071 | A | | 2/1987 | Haener | |
| 4,651,485 | A | | 3/1987 | Osborne | |
| 4,757,656 | A | * | 7/1988 | Powers, Jr. | 52/204.2 |
| 5,402,609 | A | * | 4/1995 | Kelley, Jr. | 52/98 |
| 5,457,926 | A | * | 10/1995 | Jensen | 52/604 |
| 5,465,538 | A | * | 11/1995 | Powers, Jr. | 52/204.2 |
| 5,570,552 | A | | 11/1996 | Nehring | |

(Continued)

*Primary Examiner* — William Gilbert
*Assistant Examiner* — Alp Akbasli
(74) *Attorney, Agent, or Firm* — Wendy W. Koba

(57) ABSTRACT

A mortar-less building block system including interlocking building blocks, joist hangers, truss brackets, and insulation member disposed exterior to the block; the block having a front face and a back face, a top face and a bottom face, and a protrusion side face and a recess side face all connected to form the building block; the front face and the back face each have a pair of longitudinal recesses, the top face having a pair of longitudinal recesses aligned with the longitudinal recesses of the front face and the back face, and the top face further having a transverse recess centrally located on the top face transversely intersecting the pair of longitudinal recesses, creating intersection points; the recess side face having a transverse recess aligned with the transverse recess of the top face, and the protrusion side face having a transverse protrusion designed to mate with the transverse recess of an other of the building block; the bottom face having at least one transverse protrusion for mating with the recess of a top face of an other of the building block, the transverse protrusion aligned with the recess of the recess side face, and aligned with the protrusion of the protrusion side face; the mortar-less building block having a pair of bores allowing a user to place a rod within the bore to lock multiple blocks together.

5 Claims, 15 Drawing Sheets

(56) References Cited

U.S. PATENT DOCUMENTS

| | | | | |
|---|---|---|---|---|
| 6,082,933 | A | 7/2000 | Maguire | |
| 6,142,713 | A | 11/2000 | Woolford | |
| 6,189,282 | B1 * | 2/2001 | VanderWerf | 52/582.1 |
| 6,223,493 | B1 | 5/2001 | Ruggeri | |
| 6,226,951 | B1 | 5/2001 | Azar | |
| 6,282,859 | B1 * | 9/2001 | Van Der Heijden | 52/585.1 |
| 6,508,041 | B1 | 1/2003 | Boot | |
| 6,591,569 | B2 | 7/2003 | Azar | |
| 6,665,994 | B1 | 12/2003 | Ruggeri | |
| 6,735,913 | B2 * | 5/2004 | Sanders et al. | 52/284 |
| 6,854,220 | B2 * | 2/2005 | Dueck et al. | 52/100 |
| 6,915,614 | B2 * | 7/2005 | Matsufuji | 52/600 |
| 7,007,436 | B1 * | 3/2006 | Kelley | 52/605 |
| 7,168,218 | B2 * | 1/2007 | Spratlen et al. | 52/604 |
| 7,694,485 | B1 * | 4/2010 | Siener | 52/590.2 |
| 7,762,033 | B2 * | 7/2010 | Scott et al. | 52/425 |
| 7,836,646 | B2 * | 11/2010 | Matsufuji | 52/223.7 |
| 7,946,086 | B2 * | 5/2011 | Hammer et al. | 52/223.5 |
| 8,099,918 | B2 * | 1/2012 | Marsh et al. | 52/285.2 |
| 8,171,693 | B2 * | 5/2012 | Banova | 52/592.5 |
| 2002/0083658 | A1 * | 7/2002 | Dial, Jr. | 52/125.4 |
| 2004/0020145 | A1 * | 2/2004 | Matsufuji | 52/223.7 |
| 2006/0059839 | A1 | 3/2006 | Azar | |
| 2006/0150559 | A1 | 7/2006 | Haener | |
| 2007/0017176 | A1 * | 1/2007 | Gray | 52/605 |
| 2007/0186502 | A1 * | 8/2007 | Marsh et al. | 52/604 |
| 2008/0256894 | A1 * | 10/2008 | Marsh et al. | 52/719 |

* cited by examiner

BUILDING BLOCK SYSTEM

CROSS REFERENCE TO RELATED APPLICATIONS

This patent application is a non-provisional application that claims priority to U.S. provisional application Ser. No. 61/289,002, filed on Dec. 22, 2009 and incorporates the same by reference as if set forth herein in its entirety.

BACKGROUND OF THE INVENTION

1. Field of the Invention

The invention generally relates to a building block design for use in a building block system, and more particularly, an interlocking block system incorporating interlocking building blocks, joist hangers, roof truss anchors, and thermal encapsulation members disposed on the external face of the block. The inventive building block allows for the construction of an interlocked wall and transverse wall using a plurality of blocks that all having the same design.

2. Discussion of Related Prior Art

Traditional building block structures are constructed masonry style with layers (or courses) of overlapping blocks fixed together with mortar mix between blocks and between courses. Traditional mortar-less block applications attempt to address this issue.

Osbourne, U.S. Pat. No. 4,651,485 discloses an interlocking building block system having a plurality of building blocks having ribs on some faces and recesses on other faces to receive ribs of another of the block. The blocks are stacked next to each other to form a course, and the second course is staggered above the first course such that the vertical joints of the first course do not line up with the vertical joints of an adjoining course of block. A corner block is necessary with this system to provide for a complete system. Accordingly, a transverse wall of interlocking block cannot be constructed without the additional corner block design.

The prior art discussed by Osbourne also addresses other mortar-less block applications. The prior art in general and the art discussed do not disclose the inventive building block system disclosed herein.

SUMMARY OF THE INVENTION

The present invention may be embodied as mortar-less building block for building a structure. The block designed to implement a complete system utilizing a single building block configurably adapted to be utilized in building corners of structures, transverse courses, and additional courses above the first course. The building block having a front face and a back face, a top face and a bottom face, and a protrusion side face and a recess side face all connected to form the building block. The front face and the back face each having a pair of longitudinal recesses preferably spaced apart by 8 inches. The top face having a pair of longitudinal recesses aligned with the longitudinal recesses of the front face and the back face, and the top face further having a transverse recess centrally located on the top face transversely intersecting the pair of longitudinal recesses, creating intersection points. The recess side face having a transverse recess aligned with the transverse recess of the top face. The protrusion side face having a transverse protrusion designed to mate with the transverse recess of an other of the building block. The recess side face and the protrusion side face (the side faces) are designed to interlock with other blocks to provide enhanced resistance to forces normal to the wall face. The bottom face having at least one transverse protrusion for mating with the recess of a top face of an other of the building block. The transverse protrusion of the bottom face is aligned with the recess of the recess side face, and aligned with the protrusion of the protrusion side face.

In a preferred embodiment, the mortar-less building block has a pair of bores, each bore longitudinally disposed to extend from the intersection points of the top face to corresponding bottom face intersection points, thereby allowing a user to place a rod within the bore of a first building block and within the bore of a second building block when said first and second building blocks are placed on top of each other.

The present invention includes a plurality of joist hangers for supporting a joist, each joist hanger having an upper anchoring member attached to an upper u-shaped channel, a lower anchoring member attached to a lower u-shaped channel, and one or more connective members connecting the upper u-shaped channel to the lower u-shaped channel, so to receive a joist within said upper and lower u-shaped channels. The upper and lower anchoring members having mounts for alignment with a bore of the pair of bores of the block and for receiving an anchor such as a rod or a bolt.

The present invention includes a plurality of truss brackets for anchoring a portion of a truss onto the block, each truss bracket having a recess shaped channel and a pair of arms for receiving the portion of the truss and a bore mount for anchoring the recess channel to a bore of the block with an anchor such as a rod or a bolt. The recess channel further includes a plurality of mounts for receiving a fastener such a screw or a nail for fixing the portion of the truss to the recess channel when the portion of the truss is disposed within the recess channel.

The present invention further includes a half-block for cooperating with the building block to construct openings such as doorways and windows into a wall. The half block having a front face and a back face, a top face and a bottom face, and a protrusion side face and a recess side face all connected to form the building block. The front face and the back face each having a longitudinal recess. The top face having a longitudinal recess aligned with the longitudinal recess of the front face and the back face, and the top face further having a transverse recess centrally located on the top face transversely intersecting the longitudinal recess, creating an intersection point. The recess side face having a transverse recess aligned with the transverse recess of the top face. The protrusion side face having a transverse protrusion designed to mate with the transverse recess of an other of the building block. The bottom face having at least one transverse protrusion for mating with the top face of an other of the building block, the transverse protrusion aligned with the transverse recess of the recess side face, and aligned with the transverse protrusion of the protrusion side face. The half block further having a bore extending through the half block in a direction normal to the top face to enable a rod to be placed through the bore of the half block and into the bore of another block.

The present invention may be embodied as mortar-less building block system for building a structure. The system comprising the morter-less building block as described herein, a plurality of alignment rods, a plurality of joist hangers, and a plurality of truss brackets, and an insulating member disposed exterior to the morter-less building block.

The present invention may be embodied as a thermal reservoir structural wall comprising one or more of the components of the system described herein and further comprising an insulating member applied to the exterior facing face of the block(s).

The present invention includes a method of constructing a block wall comprising placing a first block in a first location; forming a course by mating one side face of the first block with a cooperating side face of an additional block, laterally interlocking one or more additional blocks by mating one side face of the one or more additional blocks with a cooperating side face of an other of the one or more additional blocks or the additional block; forming a transverse course by mating one recess of the front or back face of the first block with a protrusion side face of an additional block, laterally interlocking one or more additional blocks by mating one side face of the one or more additional blocks with a cooperating side face of an other of the one or more additional blocks or the additional block; laying an additional course by mating the transverse protrusion of the bottom face of an additional block with either a transverse recess or a longitudinal recess of the first block or one or more additional blocks, and aligning the bore of the additional block with the bore of the first block or the one or more additional blocks; inserting a rod or alignment pin into a bore of one block and extending the rod or alignment pin into a bore of one or more additional blocks.

OBJECTS OF THE INVENTION

It is an object of the present invention to present a concept in building design and construction by using a mortar-less, self-aligning, interlocking building block that may be assembled in longitudinal staggered rows or courses to form a solid and sturdy wall structure. The blocks by the use of pins inserted through bores of the blocks, may be dry stacked or sealed with a cement-like bonding sealer on all joints.

It is another object of the present invention to provide an extreme wind resistance building system.

It is another object of the present invention to provide an earthquake resistant building.

It is another object of the present invention to provide a fire resistant building structure.

It is another object of the present invention to provide a termite resistant building structure.

It is another object of the present invention to provide interlocking building wall corners, where no corner blocks are needed, regular blocks are used on corners, to provide uniform configuration and simplicity in building block components.

It is another object of the present invention to provide a uniform interlocking building block having vertical center holes every 8 inches on center for aligning pins and rebar for building codes.

It is another object of the present invention to provide a wall structure of interlocking blocks having a vertical rectangular-trapezoidal channels interior and exterior which may be used for plumbing, electrical wires, conduit, air ducts or inserting 2×4 building lumber for structural members.

It is another object of the present invention to provide thermodynamic heat storing interior wall system by using a rigid or liquid spray foam insulation on the exterior of the wall.

It is another object of the present invention to provide a continuous vertical wall system from foundation footers to roof truss by fastening floor joists on interior walls with specially adapted joist angers and roof truss anchors.

It is another object of the present invention to provide horizontal rectangular-trapezoidal channels for roof truss anchors spaced every 8 inches on center on top row or course of blocks by the use of special truss hanger brackets secured in channels for a stronger wind resistance structural fastening roof truss system.

It is another object of the present invention to provide a wall structure building block system that would reduce structural damage in a flooding/high water situation.

It is another object of the present invention to provide blocks that are of a relatively simply uniform configuration, and walls constructed of said blocks.

It is another object of the present invention to provide a structural building block system that would reduce time and construction cost.

Accordingly, it is an object of the present invention to provide a structural block system that overcomes the drawbacks of the prior art, and other objects will become apparent in the detailed description and claims.

BRIEF DESCRIPTION OF THE DRAWINGS

The advantages, nature and various additional features of the invention will appear more fully upon consideration of the illustrative embodiment of the invention which is schematically set forth in the drawings, in which.

DETAILED DESCRIPTION OF THE DRAWINGS

Figure 1:
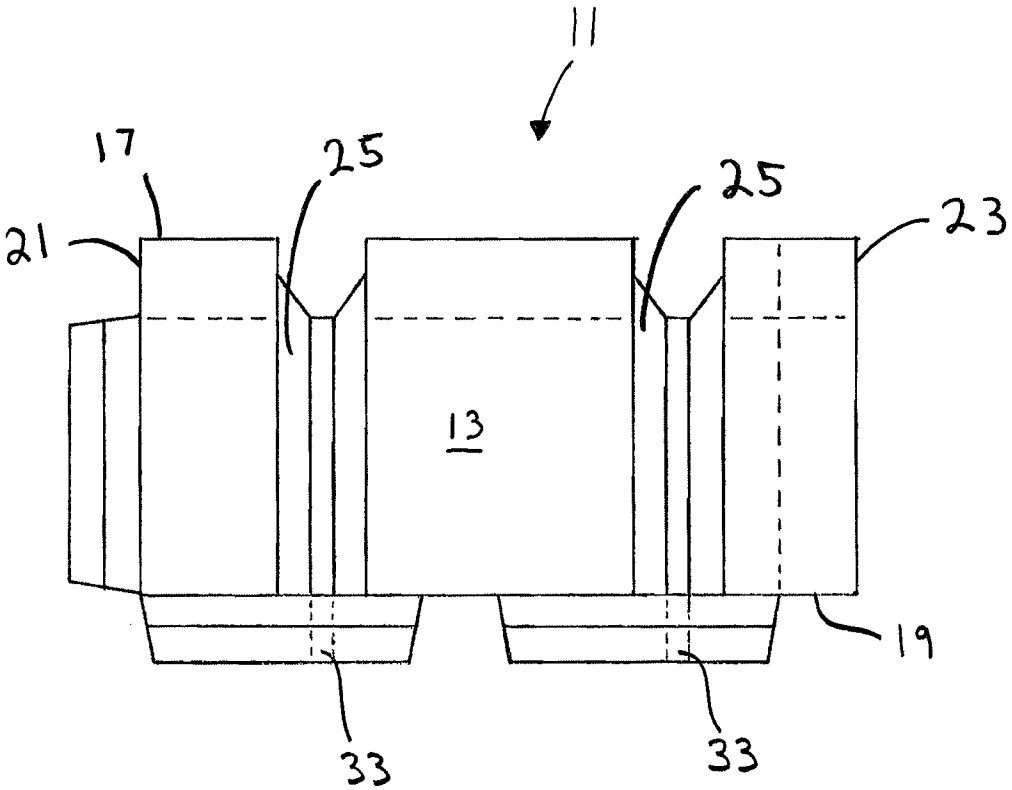
FIG. 1 is a front view of one embodiment of a channel block.

While the invention is open to various modifications and alternative forms, specific embodiments thereof are shown by way of examples in the drawings and are described herein in detail. There is no intent to limit the invention to the particular forms disclosed.

Referring now to the drawings, in particular to FIGS. 1-5, the present invention is a mortar-less building block 11 for building a structure. The building block 11 having a front face 13 and a back face 15, a top face 17 and a bottom face 19, and a protrusion side face 21 and a recess side face 23 all connected to form the building block 11.

Figure 2:
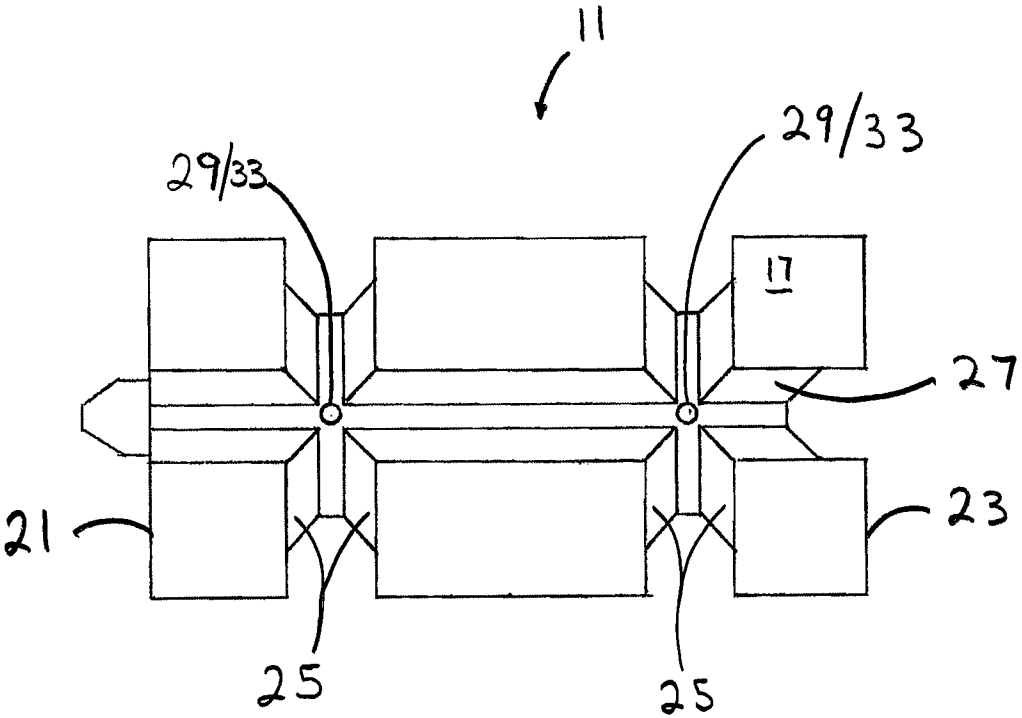
FIG. 2 is a top view of the channel block of FIG. 1.

Referring to FIGS. 1-2, the front face 13 and the back face 15 each have a pair of longitudinal recesses 25 that preferably are spaced apart by 8 inches.

Referring to FIG. 2, the top face 17 has a pair of longitudinal recesses 25 aligned with the longitudinal recesses 25 of the front face 13 and the back face 15. The top face 17 further has a transverse recess 27 centrally located on the top face 17 transversely intersecting the pair of longitudinal recesses 25, creating intersection points 29.

Figure 5:
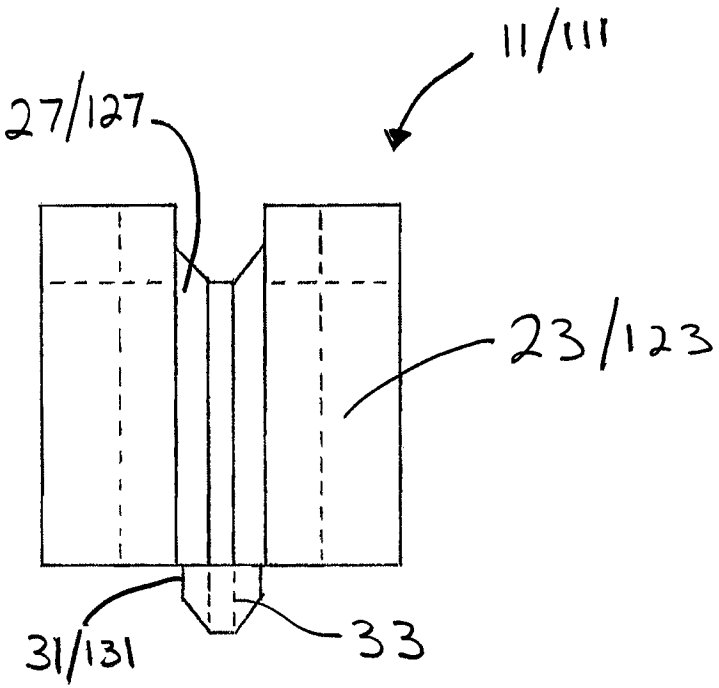
FIG. 5 is a right hand end view of the channel block of FIG. 1 and a half block.

Turning to FIG. 5, the recess side face 23 having a transverse recess 27 aligned with the transverse recess 27 of the top face 17.

Figure 6:
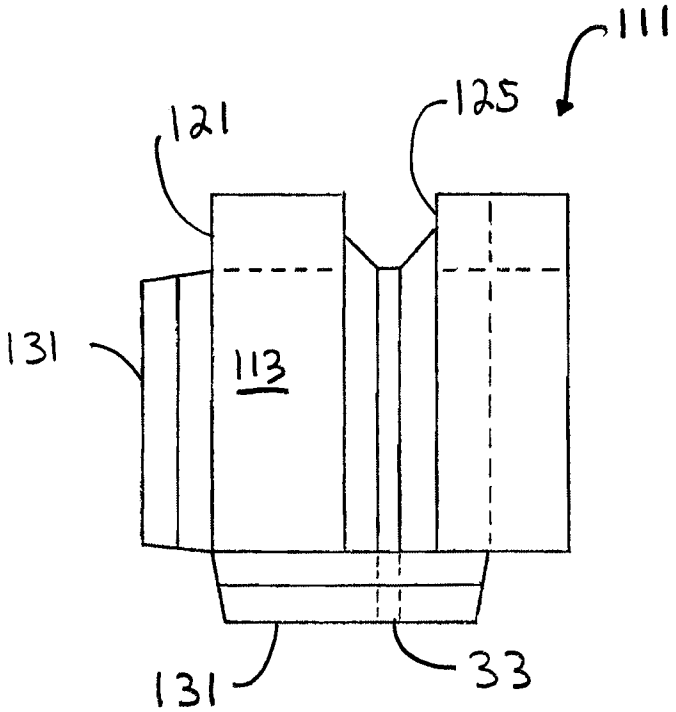
FIG. 6 is a front view of the half block.
Figure 7:
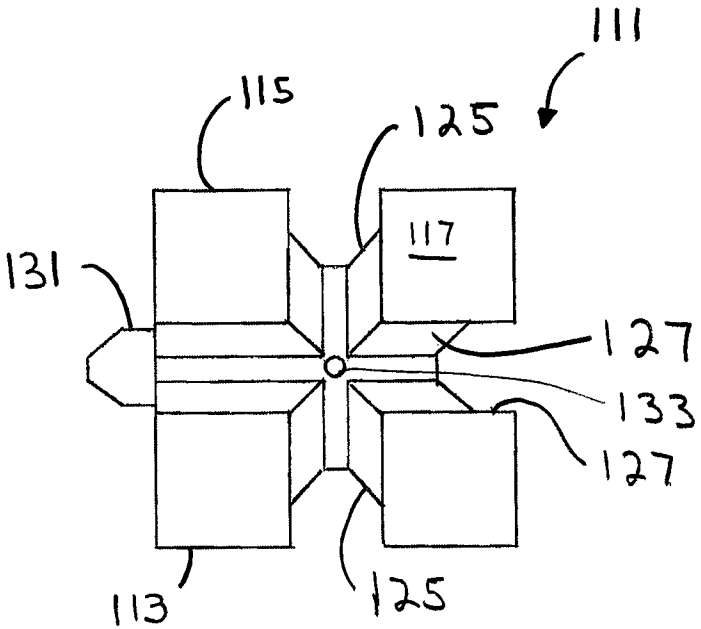
FIG. 7 is a top view of the half block.

Turning to FIG. 6, the protrusion side face 21 has a transverse protrusion 31 designed to mate with the transverse recess 27 of an other of the building block 11.

Figure 3:
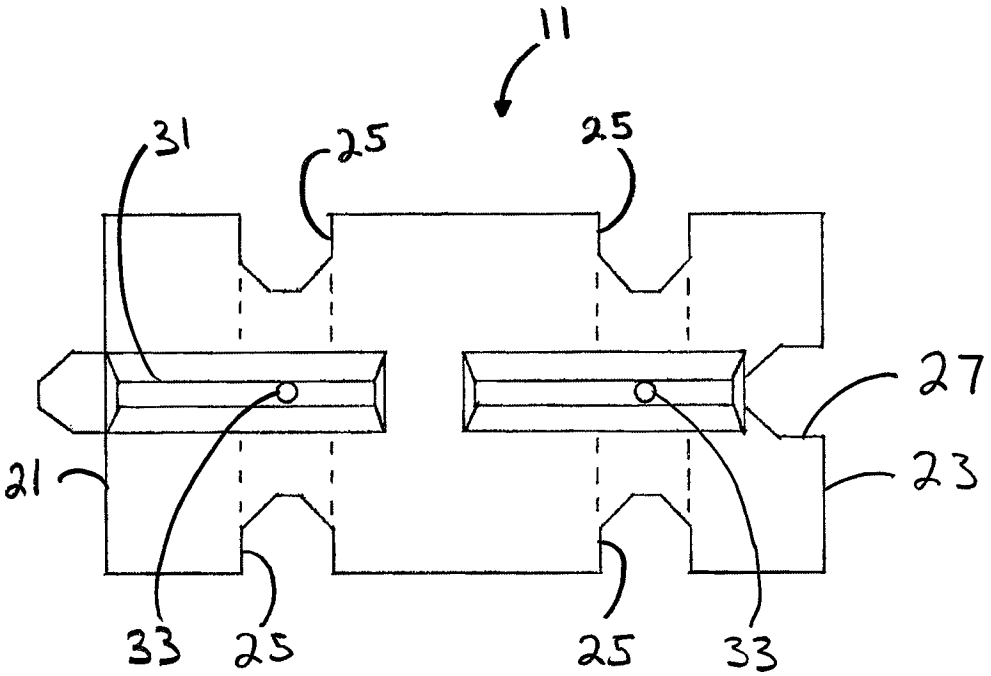
FIG. 3 is a bottom view of the channel block of FIG. 1.
Figure 4:
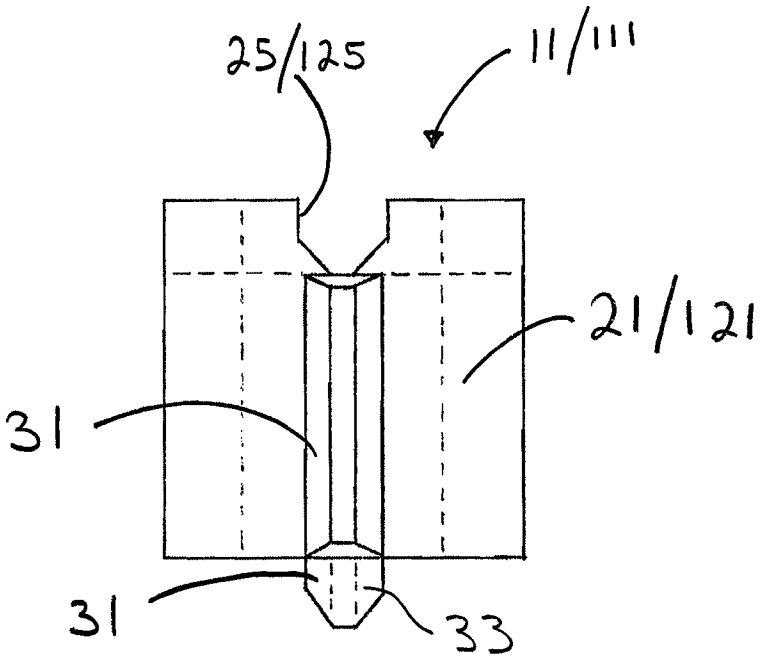
FIG. 4 is a left hand end view of the channel block of FIG. 1 and a half block.

Turning to FIG. 3, the bottom face has at least one transverse protrusion 31 for mating with a recess 25, 27 of a top face 17 of an other of the building block 11. The transverse protrusion 31 is aligned with the transverse recess 27 of the recess side face 23 and aligned with the transverse protrusion 31 of the protrusion side face 21.

The mortar-less building block 11 has a pair of bores 33, each bore 33 longitudinally disposed to extend from the intersection points 29 of the top face 17 to the bottom face 19 intersection points 29, thereby allowing a user to place a rod or pin within the bore 33 of a first building block 11 and within the bore of a second building block 11 when said first and second building blocks 11 are placed on top of each other.

In a preferred embodiment, the building block 11 is dimensioned to be a 16" by 8" block, a structural block, similar to the traditional masonry block which is standard in the trade. In an alternate embodiment, the block is half scale 8" by 4" for use as exterior facing and interior walls. Alternate scales may be employed within the spirit of the invention.

Referring to FIGS. 9-12, there is shown a joist hanger 35 for supporting a joist (not shown). The joist hanger 35 has an upper anchoring member 37 attached to an upper u-shaped channel 39, a lower anchoring member 41 attached to a lower u-shaped channel 43, and one or more connective members 45 connecting the upper u-shaped channel 39 to the lower u-shaped channel 43, so to receive a joist (not shown) within said upper and lower u-shaped channels 39, 43. The upper anchoring member 37 and lower anchoring member 41 have mounts 47 for alignment with a bore 33 of the block 11 for receiving an anchor such as a rod or a bolt.

Figure 13:
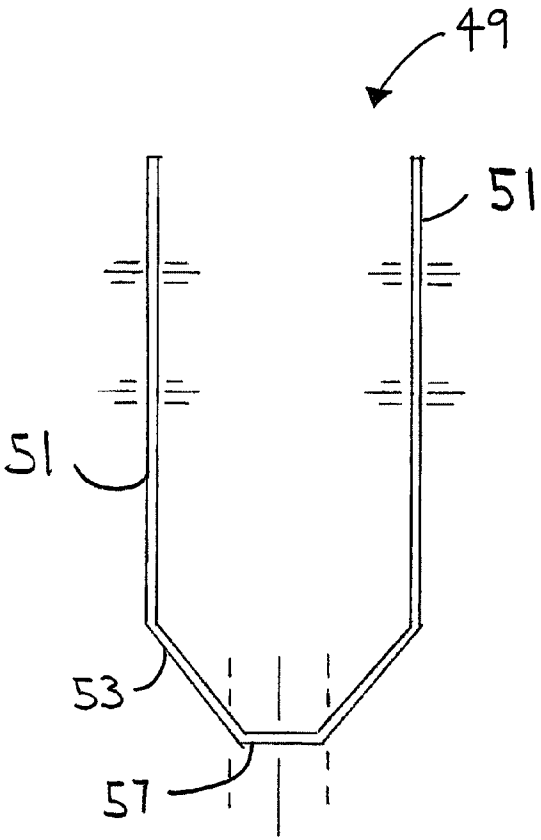
FIG. 13 is a front view of the truss bracket.
Figure 14:
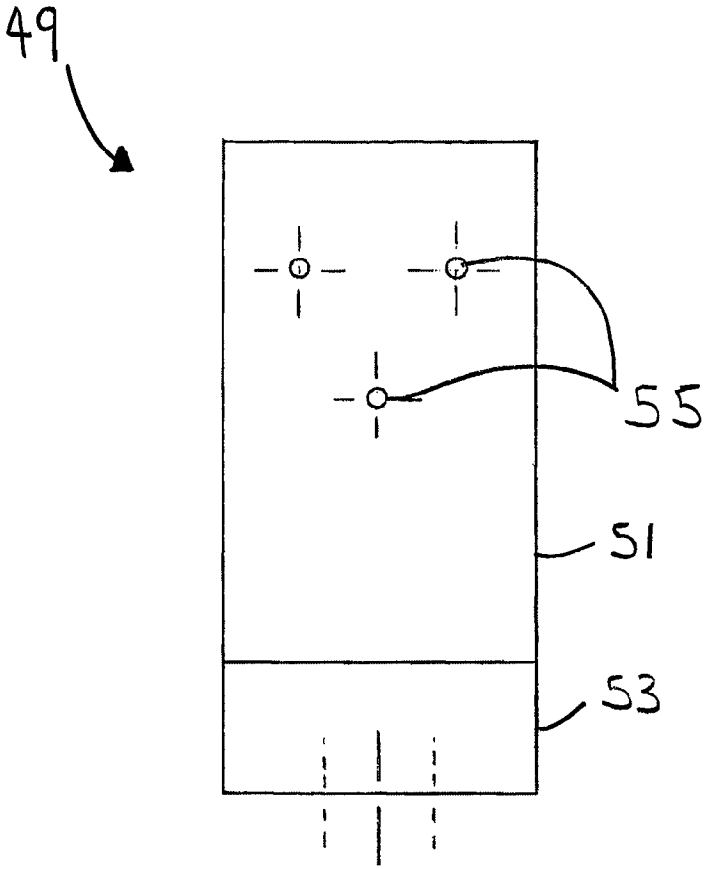
FIG. 14 is a side view of the truss bracket.
Figure 15:
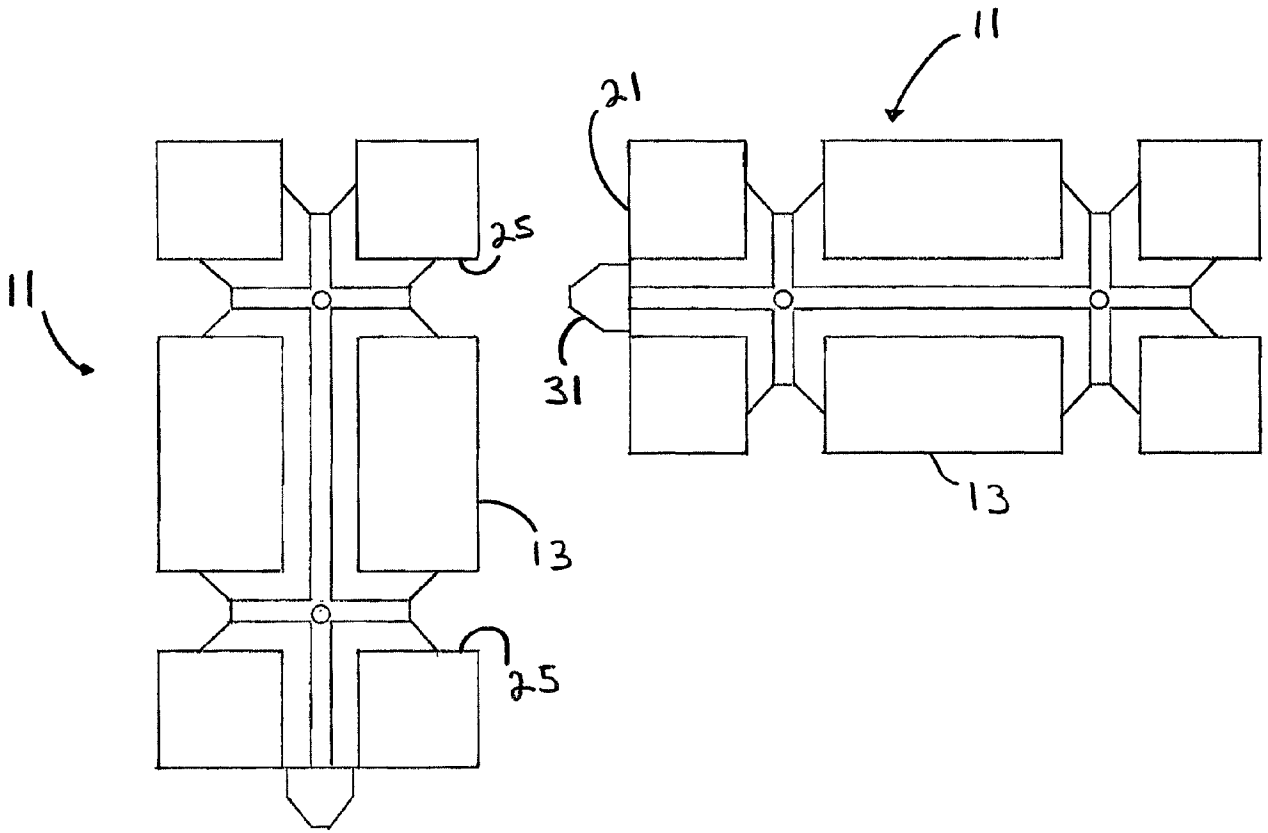
FIG. 15 is a plan view of two channel blocks.

Referring to FIGS. 13-14 there is shown a truss bracket 49 for anchoring a portion of a truss to the block 11. Each truss bracket 49 has a pair of arms 51 connected to a recess channel 53. The recess channel 53 is adapted to cooperatively fit within the longitudinal recesses 25, 125 and/or the transverse recesses 27, 127 of the building block 11. The recess channel 53 further has a bore mount 57 for fixing the truss bracket 49 to a bore 33 of the block 11 with an anchor such as a rod or a bolt. Alternately, holes are drilled into the building block 11, and bolts and molly-type anchoring systems, or the like are used to fix the truss bracket 49 to the block using the bore mount 57. The pair of arms 51 further include a plurality of mounts 55 for receiving a fastener such a screw or a nail for fixing the portion of the truss to the truss bracket when the portion of the truss is disposed within the pair of arms 51.

Referring to FIGS. 4-8, the present invention further includes a half-block 111 for cooperating with the inventive building block 11 to construct openings such as doorways and windows into a wall. The half block 111 having a front face 113 and a back face 115, a top face 117 and a bottom face 119, and a protrusion side face 121 and a recess side face 123 all connected to form the half block 111. The front face 113 and the back face 115 each having a longitudinal recess 125. The top face 113 having a longitudinal recess 125 aligned with the longitudinal recess 125 of the front face 113 and the back face 115, and the top face 117 further having a transverse recess 127 centrally located on the top face 117 transversely intersecting the longitudinal recess 125, creating an intersection point 129.

Referring to FIGS. 5-8, the recess side face 123 has a transverse recess 127 aligned with the transverse recess 127 of the top face 117. The protrusion side face 121 has a transverse protrusion 131 designed to mate with the recess 25, 125, 27, 127 of an other of the building block 11,111.

Figure 8:
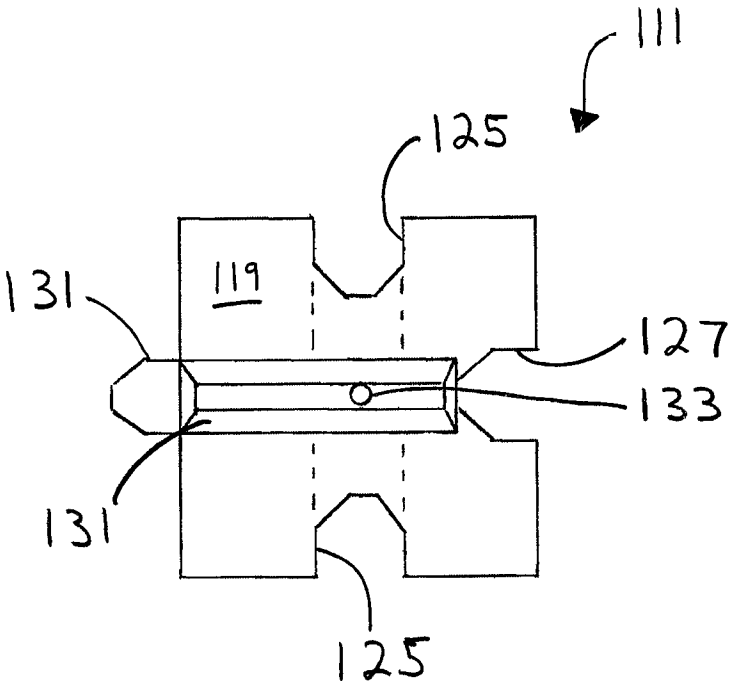
FIG. 8 is a bottom view of the half block.
Figure 9:
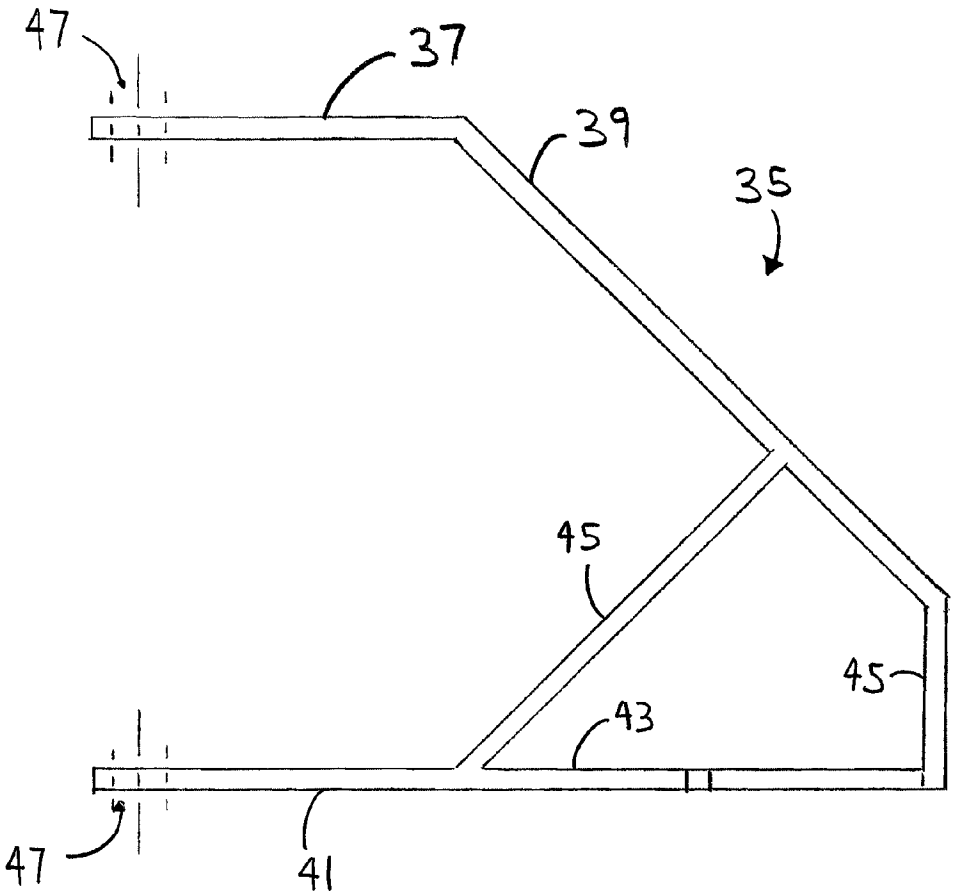
FIG. 9 is a front view of the joist hanger.
Figure 10:
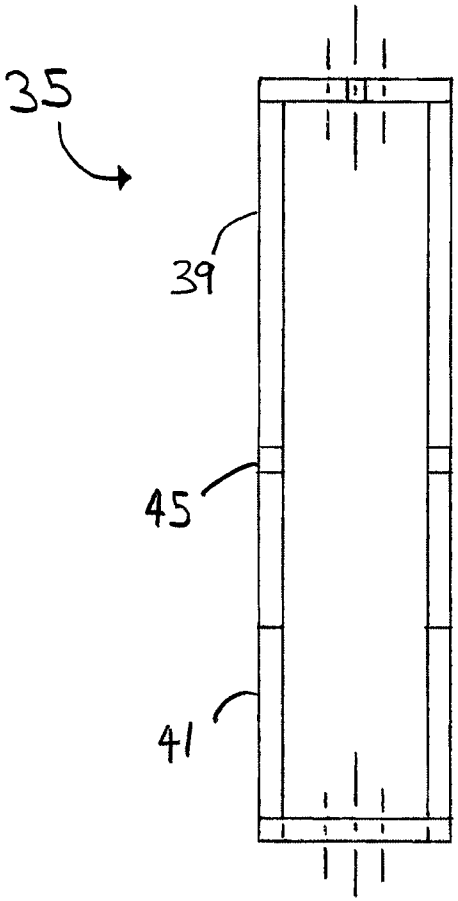
FIG. 10 is an end view of the joist hanger.
Figure 11:
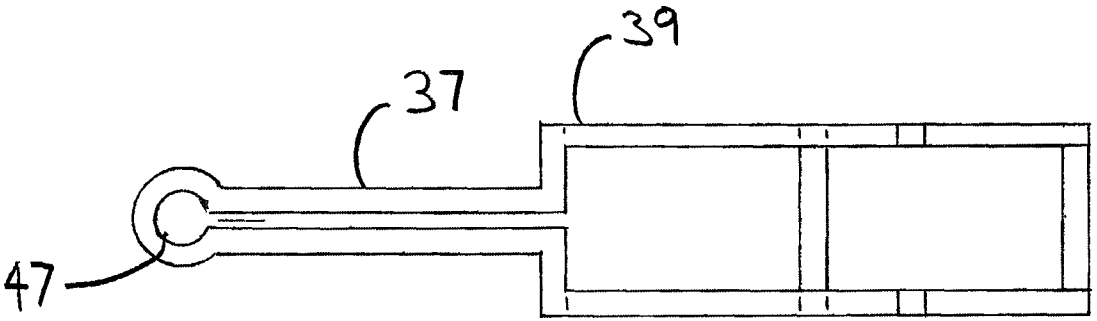
FIG. 11 is a top view of the joist hanger.
Figure 12:
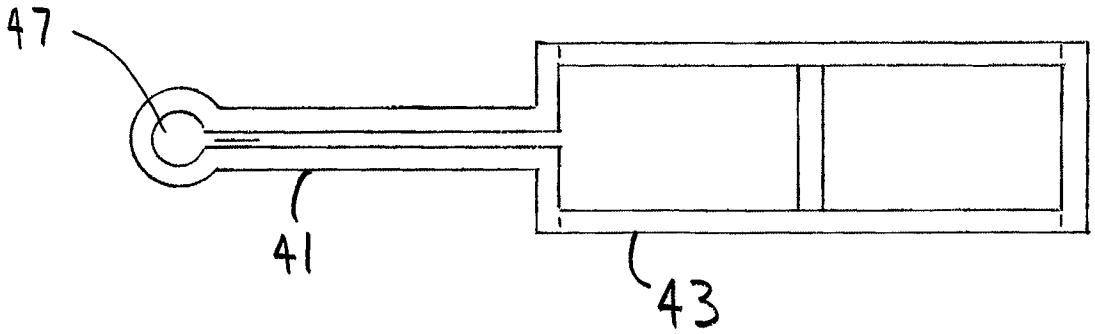
FIG. 12 is a bottom view of the joist hanger.

Turning to FIG. 8, the bottom face 119 has at least one transverse protrusion 131 for mating with the top face 17, 117 of an other of the building block 11,111. The transverse protrusion 131 is aligned with the transverse recess 27, 127 of the recess side face 23,123, and aligned with the transverse protrusion 131 of the protrusion side face 121. The half block 111, further has a bore 133 extending through the half block 11 in a direction normal to the top face 117 to enable a rod to be placed through the bore 133 of the half block 111 and into the bore 33, 133 of another block 11, 111.

The present invention may be embodied as a mortar-less building block system for building a structure. The system comprising the mortar-less building block 11, 111 as described herein, a plurality of alignment rods (not shown) a plurality of joist hangers 35, and a plurality of truss brackets 49. Preferably, an insulating member (not shown) is disposed exterior to the morter-less building block 11, 111. The insulating member preferably is a spray on foam, insulation board, or any other suitable insulating member.

The present invention may be embodied as a thermal reservoir structural wall comprising one or more of the components of the system described herein and further comprising an insulating member (not shown) applied to the exterior facing of the block(s) 11, 111.

The present invention includes a method of constructing a block wall comprising placing a first block 11, in a first location; forming a course by mating one side face 21, 23 of the first block 11 with a cooperating side face 21, 23, 121, 123 of an additional block 11, 111. One or more additional blocks 111 are laterally interlocked by mating one side face 21, 23, 121, 123 of the one or more additional blocks 11, 111 with a cooperating side face 21, 23, 121, 123 of an other of the one or more additional blocks 11,111.

A transverse course (that is a course running perpendicular to the course) is formed by mating one recess 25, 125 of the front face 13, 113 or back face 15, 115 of the first block 11 with a protrusion side face 21, 121 of an additional block 11, 111. Additional transverse courses may be formed by mating one recess 25, 125 of the front face 13, 113 or back face 15, 115 of another block 11 with a protrusion side face 21, 121 of an additional block 11, 111.

One or more additional blocks 11, 111 are laterally interlocked by mating one side face 21, 23, 121, 123 of the one or more additional blocks 11, 111 with a cooperating side face 21, 23, 121, 123, of the one or more additional blocks 11,111.

A second transverse course is set by mating the transverse protrusion 31,131 of the bottom face 19, 119 of an additional block 11, 111 with a longitudinal recess 25, 125 of the top face of the first block;

A second course is set by mating the transverse protrusion 31,131 of the bottom face 19, 119 of an additional block 11, 111 with a transverse recess of the top face of the first block;

Additional courses are set by mating the transverse protrusion 31,131 of the bottom face 19, 119 of an additional block 11, 111 with either a transverse recess 27, 127 or a longitudinal recess 25, 125 of the additional blocks 11, 111 disposed on the lower courses The bore 33, 133 of the additional block 11, 111 is aligned with the bore 33, 133 one or more additional blocks 11,111, and a rod or pin is inserted into a bore of one block 11, 111 and extending the rod or alignment pin into a bore 33 of one or more additional blocks 11, 111.

A joist hanger 35 is set by aligning the mount 47 of the upper anchor member 37 with a bore 33 on the top face 17, 117 of a block 11, 111. The mount 47 of the lower anchor member 41 is also aligned with a bore on the bottom face 19, 119 of the block 11, 111. A pin or a rod is passed through the mount 47 of the upper anchor member 37, though the bore 33 of the block 11, 111, through the lower anchor member 41 of the joist hanger 35, and preferably through a bore 33 of another block 11, 111 situated above or below the joist hanger 35.

A truss bracket 49 is provided to mount a truss member (not shown) to a wall constructed of block 11, 111. The truss bracket 49 is fixed to a block 11, 111 by aligning the bore mount 57 with a bore 33 of the block 11, 111 and inserting a bolt, rod, or pin to fix the truss bracket 49 to the block 11, 111. Alternately, other anchoring systems (such as drilling holes and/or inserting molly anchors and bolts) can be used to fix the truss bracket 49 to the wall.

For interior finishing, a flush support bracket may be utilized, which comprises a recess fitting member connected to or integral with a recess extending member. The recess fitting member is adapted to fit within a recess 25, 125, 27, 127 of a block 11, 111 and extend beyond the face of the block 11, 111 to allow attachment of junction boxes and the like.

The Appendix, a copy of which is attached hereto, comprises papers that discuss the invention, and is incorporated by reference as if set forth entirely herein.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A method of constructing a structure comprising the steps of:

providing a plurality of alignment rods and a plurality of mortar-less building blocks, each of the plurality of blocks formed of masonry material and including a front face and a back face, a top face and a bottom face, and a protrusion side face and a recess side face;

the front face and the back face each include a single pair of longitudinal recesses, the top face includes a single pair of longitudinal recesses aligned with and extending to join in a one-to-one relationship with the longitudinal recesses of the front face and the back face, the top face also including a transverse recess centrally located on the top face for transversely intersecting the single pair of longitudinal recesses, creating intersection points, the recess side face having a transverse recess aligned with and extending to join the transverse recess of the top face, the protrusion side face having a transverse protrusion designed to mate with the transverse recess of an other of the building block, the bottom face having at least one transverse protrusion for mating with a recess of a top face of an other of the building block, the transverse protrusion being aligned with and extending to the transverse recess of the recess side face and aligned with and extending to the transverse protrusion of the protrusion side face, and a pair of bores, each bore longitudinally disposed to extend through the solid masonry material forming the building block from the intersection points of the top face to the bottom face intersection points, for allowing a user to place an alignment rod within the bore of a first building block and within the bore of a second building block when said first and second building blocks are placed on top of each other;

placing a first block in a first location;

forming a course by mating one side face of the first block with a cooperating side face of an additional block such that the protrusion side face of the first block is mated with the recess side face of the additional block, or the recess side face of the first block is mated with the protrusion side face of the additional block;

laterally interlocking one or more additional blocks by mating one side face of the one or more additional blocks with a cooperating, oppositely-configured side face of an other of the one or more additional blocks;

forming a transverse course by (a) mating one recess of the front face or back face of the first block with a protrusion side face of an additional block and (b) laterally interlocking one or more additional blocks by mating one side face of the one or more additional blocks with a cooperating, oppositely-configured side face of an other of the one or more additional blocks;

setting a second transverse course by mating the transverse protrusion of the bottom face of an additional block with a longitudinal recess of the top face of the first block;

setting a second course by mating the transverse protrusion of the bottom face of an additional block with a longitudinal recess of the top face of the first block;

aligning the bore of the additional block with the bore one or more additional blocks; and inserting an alignment rod into a bore of one block and extending the alignment rod into a bore of one or more additional blocks.

2. The method of claim 1, further including the steps of:

providing a plurality of joist hangers, each of the plurality of joist hangers including an upper anchoring member attached to an upper u-shaped channel, a lower anchoring member attached to a lower u-shaped channel, and one or more connective members connecting the upper u-shaped channel to the lower u-shaped channel, so to receive a portion of joist within said upper and lower u-shaped channels, the upper anchoring member and lower anchoring member having mounts for alignment with a bore of the block for receiving the alignment rod, setting a joist hanger by aligning the mount of the upper anchor member with a bore on the top face of a block and aligning the mount of the lower anchor member with a bore on the bottom face of the block, passing the alignment rod through the mount of the upper anchor members, through the bore of the block through the lower anchor member of the joist hanger and through a bore of another block situated above or below the joist hanger.

3. The method of claim 2, further including the step of providing a plurality of joists, and inserting one end of a joist into the lower u-shaped channel, and the upper u-shaped channel of a joist hanger.

4. The method of claim 3, further including the steps of:

providing a plurality of truss brackets, each of the plurality of truss brackets having a pair of arms connected to a recess channel, the recess channel adapted to cooperatively fit within the longitudinal recesses and/or the transverse recesses of the building block, and the recess channel further having a bore mount for fixing the truss bracket to a bore of the block with one or more of the plurality of alignment rods and the pair of arms includes a plurality of mounts for receiving a fastener for fixing the portion of the truss to the truss bracket when the portion of the truss is disposed within the pair of arms, fixing the truss bracket to a block by aligning the bore mount with a bore of the block and inserting a fastener to fix the truss bracket to the block.

5. The method of claim 4, further including the step of providing a plurality of trusses, and inserting one portion of a truss into the pair of arms of the truss bracket, and fixing the truss to the truss bracket by passing a fastener through at least one of the plurality of mounts of the truss bracket.

* * * * *